US008449264B2

(12) United States Patent
Schwarz

(10) Patent No.: US 8,449,264 B2
(45) Date of Patent: May 28, 2013

(54) METHOD FOR DELIVERING FLUIDS USING A CENTRIFUGAL PUMP

(75) Inventor: Gerhard Schwarz, Dackenheim (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 13/333,342

(22) Filed: Dec. 21, 2011

(65) Prior Publication Data

US 2012/0111419 A1 May 10, 2012

Related U.S. Application Data

(63) Continuation of application No. PCT/EP2010/058967, filed on Jun. 24, 2010.

(30) Foreign Application Priority Data

Jun. 30, 2009 (DE) ..... 10 2009 031 309

(51) Int. Cl.
*F04D 7/02* (2006.01)
*F04B 23/14* (2006.01)

(52) U.S. Cl.
USPC ..... 417/53; 417/201; 417/205; 62/50.6

(58) Field of Classification Search
USPC ..... 137/14, 565.3; 417/18, 32, 44.2, 417/53, 201, 205; 62/45.1, 50.6
See application file for complete search history.

(56) References Cited

U.S. PATENT DOCUMENTS 3,848,427 A * 11/1974 Loofbourow ..... 62/260
3,950,958 A * 4/1976 Loofbourow ..... 62/260
4,747,749 A 5/1988 Sagnes
6,170,264 B1 * 1/2001 Viteri et al. ..... 60/671
6,224,355 B1 5/2001 Forthuber
6,332,336 B1 * 12/2001 Mirsky et al. ..... 62/613
6,584,781 B2 * 7/2003 Bishop et al. ..... 62/54.1
6,751,985 B2 * 6/2004 Kimble et al. ..... 62/613
6,994,104 B2 * 2/2006 Bishop et al. ..... 62/45.1
7,137,260 B2 * 11/2006 Perry ..... 62/46.1

(Continued)

FOREIGN PATENT DOCUMENTS

GB 2 273 958 A 7/1994
WO WO 99/41490 A1 8/1999

(Continued)

OTHER PUBLICATIONS

English Translation of International Preliminary Report on Patentability with Written Opinion dated Jan. 17, 2012, (four (4) pages).

Gouq-Jen Su, "Modified Law of Corresponding States for Real Gases", Industrial and Engineering Chemistry, American Chemical Society, vol. 38, No. 8, pp. 803-806, Aug. 1, 1946, XP007914075.

(Continued)

*Primary Examiner* — John Rivell

(74) *Attorney, Agent, or Firm* — Crowell & Moring LLP

(57) ABSTRACT

A method for delivering a fluid using a centrifugal pump (11). Machines (1, 6) and/or apparatus (3, 8), which influence the pressure and/or the temperature of the fluid, are disposed upstream of the centrifugal pump (11). At the inlet to the centrifugal pump (11), the fluid is regulated to achieve a specific entry state. According to the invention, the entry state of the fluid is regulated by using the machines (1, 6) or apparatus (3, 8) such that, in the centrifugal pump (11), the fluid only takes on states in which the compressibility factor of the fluid has already reached or exceeded the minimum thereof.

18 Claims, 6 Drawing Sheets

U.S. PATENT DOCUMENTS

| | | | |
|---|---|---|---|
| 2005/0112003 | A1 | 5/2005 | Jones et al. |
| 2005/0154479 | A1 | 7/2005 | Narayanan et al. |
| 2005/0155378 | A1 | 7/2005 | Gershtein et al. |

FOREIGN PATENT DOCUMENTS

| | | | |
|---|---|---|---|
| WO | WO 00/63529 | A1 | 10/2000 |
| WO | WO 2005/052365 | A2 | 6/2005 |
| WO | WO 2008/009930 | A2 | 1/2008 |

OTHER PUBLICATIONS

PCT/ISA/237.

International Search Report dated Jul. 30, 2010 with partial English language translation.

Germany Office Action dated Oct. 1, 2010 with partial English language translation.

* cited by examiner

METHOD FOR DELIVERING FLUIDS USING A CENTRIFUGAL PUMP

CROSS REFERENCE TO RELATED APPLICATIONS

This application is a continuation of international patent application no. PCT/EP2010/058967, filed Jun. 24, 2010, designating the United States of America and published in German on Jan. 6, 2011 as WO 2011/000761, the entire disclosure of which is incorporated herein by reference. Priority is claimed based on Federal Republic of Germany patent application no. DE 10 2009 031 309.5, filed Jun. 30, 2009, the entire disclosure of which is likewise incorporated herein by reference.

BACKGROUND OF THE INVENTION

The invention relates to a method for the conveyance of a fluid by using centrifugal pumps, with machines and/or appliances which influence the pressure and/or temperature of the fluid being arranged upstream of a centrifugal pump. The invention relates, furthermore, to a method for the sequestration of carbon dioxide, the carbon dioxide being brought to a pressure and/or temperature suitable for deposit in an intended storage location and being conveyed into the storage location.

In the combustion of fossil fuels in power stations, carbon dioxide is produced which is critically responsible for the greenhouse effect. The aim, therefore, is to reduce the emission of carbon dioxide into the atmosphere. An effective measure is the sequestration of carbon dioxide. In this case, the carbon dioxide which has been produced in the power stations is separated and is delivered to a storage location. Appropriate storage locations include geological formations, such as petroleum deposits, natural gas deposits, saline groundwater aquifers or coal seams. Deep sea storage has also been investigated.

In conventional methods, the conveyance of gaseous carbon dioxide takes place by using compressors. Compression takes place in several stages, with various intermediate coolings of the compressed gas being necessary. Compression occurs from the gaseous state directly into the supercritical state. Both compression and cooling are highly energy-intensive.

Liquid carbon dioxide has also occasionally been conveyed by diaphragm pumps. If liquid carbon dioxide is pumped, then it is necessary to ensure that cavitation does not occur in the pump. The carbon dioxide should assume only states in which the vapor pressure is not reached or is undershot. Otherwise, the formation of vapor bubbles occurs, which implode in the event of overpressurizing the pump and lead to severe damage. The vapor pressure curve thus constitutes a boundary line for the conveyance of liquid carbon dioxide.

When liquid carbon dioxide is being conveyed, an unavoidable change to a supercritical state may occur in the pump. This is because of its relatively low critical temperature of only 31.0° C. and its relatively low critical pressure of only 73.8 bar. Furthermore, there are methods in which the carbon dioxide is in the supercritical state even when it enters the pump.

In principle, the conveyance of supercritical carbon dioxide by using centrifugal pumps is known. Jones et al., US 2005/0112003 (=WO 2005/052365) describes a single-stage canned motor pump which conveys the supercritical carbon dioxide in circulation. The fluid is conveyed by an impeller fastened on a shaft which is arranged in corrosion-resistant bearings. This is intended to prevent the formation of abrasive particles which may destroy the high-speed canned motor.

Forthuber, U.S. Pat. No. 6,224,355 (=WO 00/63529) describes a pump system for conveying liquid or supercritical carbon dioxide. The pump system comprises a multistage pump constructed in the manner of a submersible motor pump which is arranged in a pot housing. This arrangement relies on a closed conveying system in which very high pump inlet pressures prevail. Due to the boundary conditions mentioned, the carbon dioxide to be conveyed is present solely in the liquid phase. The system is used for enhanced oil recovery, EOR, in which carbon dioxide is injected into oilfields in order to increase the yield of conveyed oil. The system also serves for the sequestration of carbon dioxide.

In the conveyance of supercritical carbon dioxide by centrifugal pumps, serious problems often arise, since in the supercritical range, the carbon dioxide repeatedly assumes states which lead to discontinuous pumping behavior and sometimes also to damage to the centrifugal pump. In the event of a pressure rise in the centrifugal pump, pronounced changes in density of the fluid occur which cause this behavior.

SUMMARY OF THE INVENTION

The object of the present invention is to provide a method which makes it possible to convey supercritical fluids by using centrifugal pumps, while assuring that inadmissible changes in the density of the fluid to be conveyed are avoided.

This object is achieved, according to the invention, in that the state in which the fluid enters into the centrifugal pump is set by machines and/or appliances such that the fluid in the centrifugal pump assumes only states in which the real gas factor of the fluid has already reached or exceeded its minimum.

The real gas factor, which is also designated as the compressibility or compression factor, is defined as $$z = \frac{p \cdot V}{n \cdot R \cdot T} = \frac{p \cdot V}{m \cdot R_i \cdot T} = \frac{p \cdot v}{R_i \cdot T}$$

In which the individual formula symbols stand for the following variables:

| | |
|---|---|
| p—pressure, | [p] = bar |
| V—volume, | [V] = $m^3$ |
| n—substance quantity, | [n] = mol |
| T—absolute temperature, | [T] = K |
| R—universal gas constant, | $R = 8.3145 \frac{j}{mol \cdot K}$ |
| m—mass, | [m] = kg |
| $R_i$—specific gas constant of the substance i, | $[R] = \frac{j}{kg \cdot K}$ |
| v—specific volume, | $[v] = \frac{m^3}{kg}$ |

While the real gas factor is equal to one for ideal gases, it deviates for real gases as a function of pressure and temperature. In this case, the real gas factor first decreases with rising pressure below what is known as Boyle's temperature, reaches a minimum and then rises again. The method according to the invention ensures that the fluid in the centrifugal pump assumes only states in which the real gas factor has already reached or exceeded its minimum. If the centrifugal pump operates in these permitted operating ranges, discontinuous pumping behavior and damage to the centrifugal pump during the conveyance of supercritical fluids are reliably prevented.

In the liquid range, a boundary line, which should not be reached or undershot during conveyance, has long been known for operating centrifugal pumps. In the case of liquids, the vapor pressure curve constitutes this boundary line. If it is undershot, cavitation occurs. By contrast, for the supercritical range, there is no boundary line similar to the vapor pressure curve, since this terminates at the critical point.

According to the invention, for the first time, a boundary line for operating centrifugal pumps, which should not be undershot during conveyance, is defined for the supercritical range. By virtue of the method according to the invention, the certainty of avoiding inadmissible changes in density of the fluid to be conveyed is ensured in the supercritical range.

During the pumping operation, pressure increases and temperature rises occur in the centrifugal pump. The states which a fluid assumes in the centrifugal pump are dependent on the conveying situation and on the type of centrifugal pump used. The operator is usually aware of these. The machines and appliances used in the method configure the state of entry of the fluid such that its real gas factor has already reached or exceeded its minimum at least upon entry into the centrifugal pump.

In the method, the fluid may be in a supercritical state even upon entry into the centrifugal pump. It is likewise possible that the fluid is first liquid upon entry into the centrifugal pump and assumes a supercritical state only in the centrifugal pump. In this case too, the boundary line according to the invention must be maintained.

Preferably, the state of the fluid as it enters the pump is set by compressors and heat exchangers. In this case, it proves beneficial if the fluid passes through at least one compression and at least one cooling stage. The state of entry of the fluid into the centrifugal pump is set via the number of compression and cooling stages.

The state of entry is usually deemed to be the state of the fluid upon entry into the suction connection piece of the centrifugal pump. A state of entry according to the invention must be reached, however, at the latest upon the entry of the fluid into the impeller chamber.

In an especially preferred embodiment of the invention, the inlet temperature and/or inlet pressure of the fluid are/is measured and transmitted to a control and/or regulating unit. Commercially available controls or controllers may be used as the control and/or regulating unit. The use of a process management system may also be envisioned. The machines and appliances can be influenced in a directed manner via the control and/or regulating unit in order to set the state of entry of the fluid. For this purpose, the control and/or regulating unit sends signals to the machines and appliances. The drive motors or actuating drives of the machines and appliances are influenced via the signals.

In one advantageous embodiment of the invention, the control and/or regulating unit triggers an alarm when the real gas factor of the fluid upon entry into the pump has not yet reached its minimum. In this case, additionally or alternatively, the plant may also be brought into a safety operating mode, or a shutdown of the centrifugal pump may also occur in such a case.

BRIEF DESCRIPTION OF THE DRAWINGS

The invention will be described in further detail hereinafter with reference to illustrative preferred embodiments depicted in the accompanying drawing figures, in which.

DETAILED DESCRIPTION OF PREFERRED EMBODIMENTS

Figure 1:
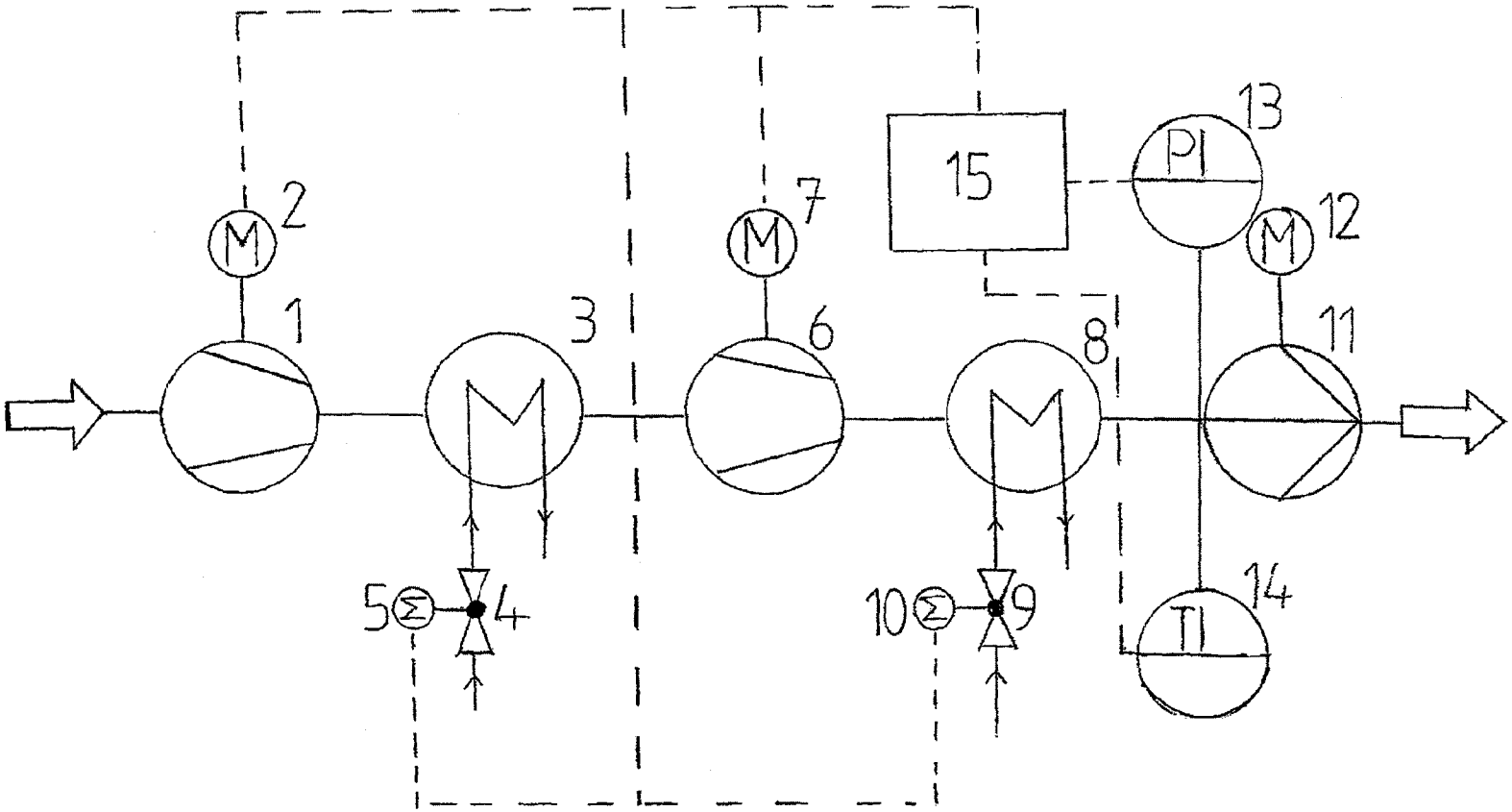
FIG. 1 shows a flow chart of the method according to the invention.

FIG. 1 shows a flow chart of the method according to the invention as a diagrammatic illustration. The fluid, which in this case is carbon dioxide, first enters a compressor 1. The compressor 1 is driven by a motor 2. This diagrammatic illustration applies to single-stage or multistage compressor forms of construction. The number of compressor and heat exchanger stages varies as a function of the state of entry of the fluid and coolant in the process illustrated. For the sake of clarity, only 2 process stages are illustrated here; however, there are usually several.

In the compressor 1, the fluid is brought to a higher pressure, the temperature of the fluid rising. Downstream of the compressor 1, the fluid enters a heat exchanger 3. The heat exchanger 3 through which coolant flows absorbs heat from the fluid stream and consequently lowers the temperature of the fluid. The coolant quantity is set by using a valve 4. As its actuating drive, the valve 4 is operated by a motor 5.

Downstream of the heat exchanger 3, the carbon dioxide can enter a further compressor 6 or a further compressor stage, which is operated here by using a motor 7. In the further compressor 6, the fluid experiences a renewed pressure and temperature rise before it enters a further heat exchanger 8, which may also be constructed as an intermediate cooler. In the heat exchanger 8, the carbon dioxide stream is cooled once again. This likewise takes place by using a coolant stream which is regulated via a valve 9 which has a motor 10 as its actuating drive.

According to the invention, the state of entry of the fluid into the centrifugal pump 11 is set via the machines 1, 6 and appliances 3, 8 such that the fluid in the centrifugal pump 11 assumes only states in which the real gas factor has already reached or exceeded its minimum value. For this purpose, the states of aggregation of the fluid are detected at entry into the centrifugal pump 11 by using conventional pressure and temperature measurement points 13, 14. The measurement points 13, 14 are connected to a regulating unit 15 which regulates the machines 1, 6 and appliances 3, 8. The regulating unit 15 ensures that, upstream of the centrifugal pump 11, those states of aggregation are set, on the basis of which the centrifugal pump can be operated safely. The motor 12 of the centrifugal pump 11 can also be influenced by the regulating unit 15 if it is designed correspondingly. The use of variable-speed motors is advantageous for the process. This depends on the boundary conditions given in each case for the method or its plant.

The pressure measurement point 13, identified by the abbreviation Pl, measures the pressure of the carbon dioxide. If there is a risk that the carbon dioxide within the centrifugal pump 11 may assume a state in the prohibited range in which the real gas factor has not yet reached its minimum, its signals are transmitted via the regulating unit 15 to the motors 2, 7 of the compressors 1, 6, via which the pressure of the carbon dioxide can be set.

The temperature measurement point 14, identified by the abbreviation Tl, measures the temperature of the carbon dioxide. If there is a risk that the carbon dioxide within the centrifugal pump 11 may assume a state in the prohibited range in which the real gas factor has not yet reached its minimum, its signals are transmitted via the regulating unit 15 to the motors 5, 10 of the valves 4, 9, via which the temperature of the carbon dioxide can be set by using the coolant stream which flows through the heat exchangers 3, 8. Possible further sensors which monitor the machines 1, 6 and appliances 3, 8 are not illustrated for the sake of greater clarity and would likewise be connected to the regulating unit 15 for the purpose of influencing the method.

The carbon dioxide leaves the centrifugal pump 11 in a state required for the follow-up process. In contrast to conventional methods in which only compressors are used for conveying carbon dioxide, high pressure differences can be implemented in the centrifugal pump, without additional intermediate cooling, by using the method according to the invention.

Figure 2:
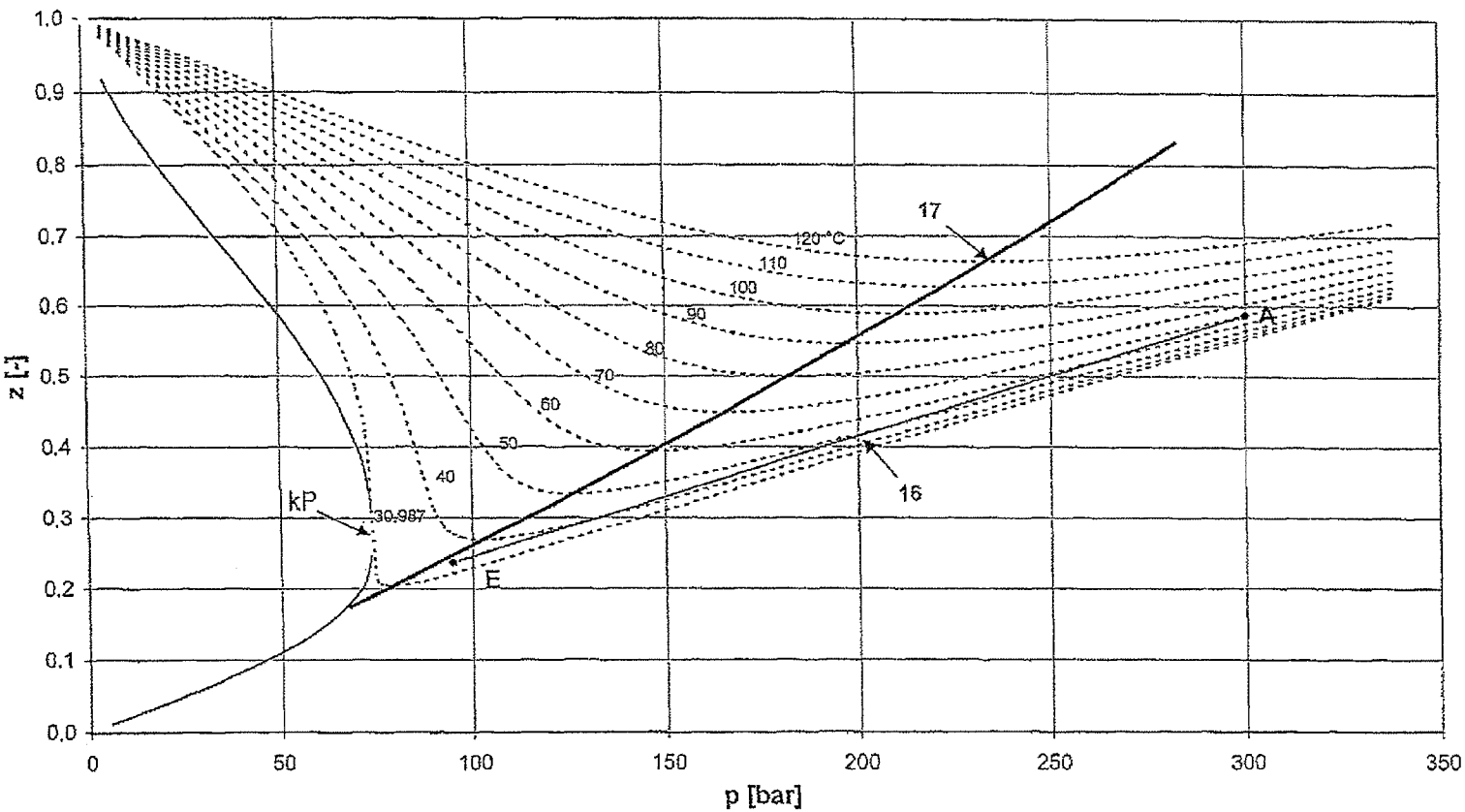
FIG. 2 shows a graph in which the real gas factor of carbon dioxide is shown as a function of the pressure.

FIG. 2 illustrates a graph in which carbon dioxide, the real gas factor z of which is plotted as a function of the pressure p, is the fluid to be conveyed. According to the invention, the state in which the fluid enters the pump is set by the machines 1, 6 and/or appliances 3, 8 such that the fluid, when it flows through the centrifugal pump 11, assumes only states in which the real gas factor has already reached or exceeded its minimum. In the event of an increase in pressure in the centrifugal pump, the real gas factor of the fluid remains the same or increases.

FIG. 2 illustrates an operating curve 16 for a centrifugal pump 11, in which both the state of entry E and the state of exit A of the fluid lie in the permitted range. The fluid is present upon entry into the centrifugal pump 11 in a state in which the real gas factor z has already exceeded its minimum. The pressure p and temperature T of the fluid change in the pump 11. The fluid enters the pump 11 here at a pressure of 95 bar and leaves the pump 11 at a pressure of 300 bar. The inlet temperature of the fluid amounts to about 35° C. and the outlet temperature of the fluid to about 70° C. According to the invention, the state of entry of the fluid was set by the machines 1, 6 and/or appliances 3, 8 such that the fluid in the centrifugal pump 11 assumes only states in which the real gas factor z has already reached or exceeded its minimum.

By the minima of individual isotherms, illustrated by dashes, of the fluid being connected up in the graph of FIG. 2, a bold unbroken boundary curve 17 is defined for pumpable fluids in the supercritical range. This supercritical range is located on the right of the supercritical point kP of the fluid. According to the invention, the boundary curve 17 for operating centrifugal pumps is thereby defined for the supercritical range. The carbon dioxide should assume in the centrifugal pump 11 only states which lie on this boundary curve 17 or to the right of it. In this range, the real gas factor of the carbon dioxide has already reached or exceeded its minimum. The operating curve 16 of the centrifugal pump 11 lies completely in the permitted range.

Figure 3:
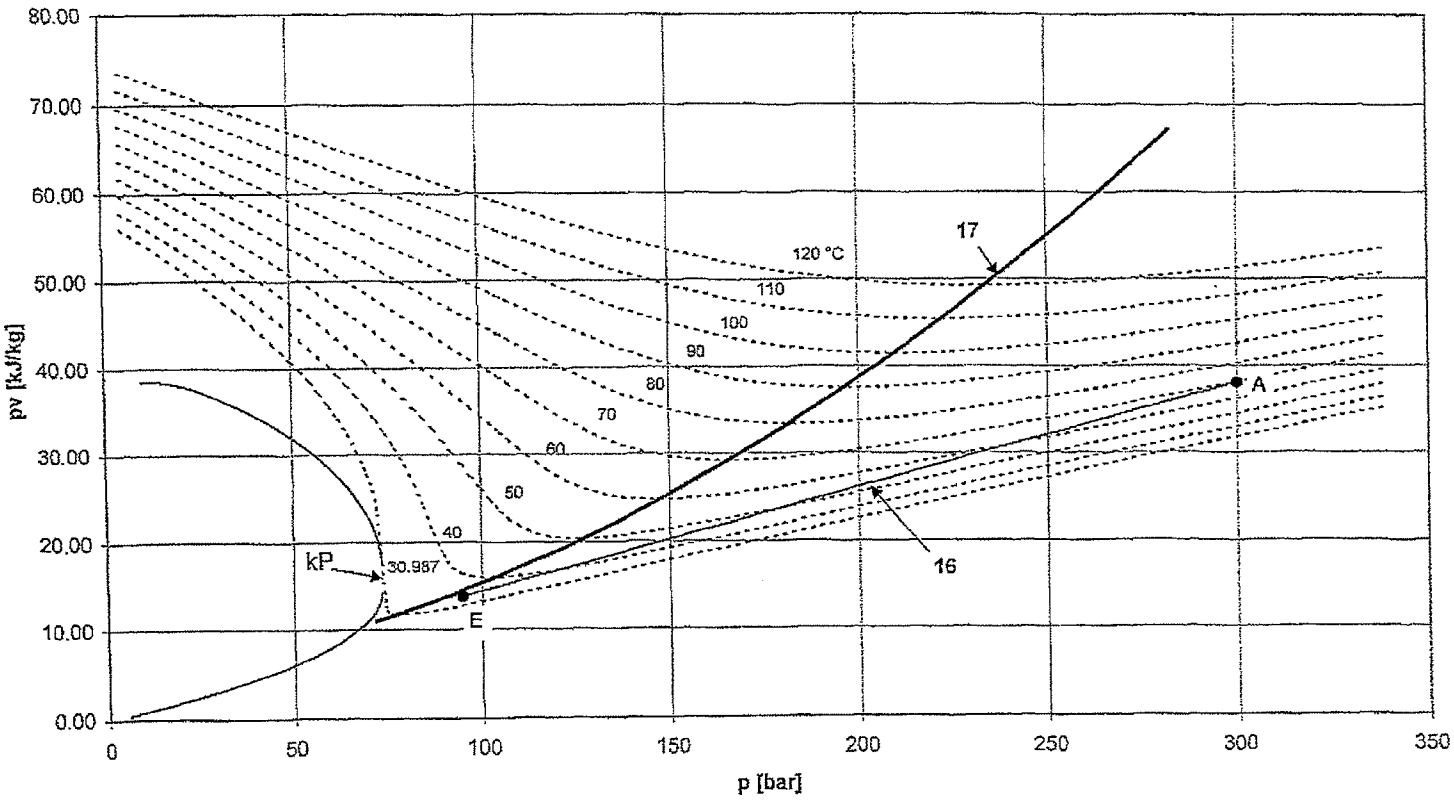
FIG. 3 shows a graph in which the product p·v of the carbon dioxide is illustrated as a function of the pressure.

FIG. 3 shows a graph in which the product p·v is plotted as a function of the pressure p for carbon dioxide. The product p·v may be considered in a similar way to the real gas factor z. While the isotherms run horizontally for an ideal gas behavior, real gases exhibit a behavior which is illustrated in FIG. 3 by dashed isotherms. The product p·v is first reached on an isotherm with rising pressure lower up to a minimum. After passing through the respective minimum, the product p·v becomes higher again with rising pressure. The product p·v in this case increases approximately linearly. According to the invention, the state of entry of the fluid is set with the aid of machines 1, 6 and/or appliances 3, 8 such that the product p·v of the fluid in the centrifugal pump 11 has already reached or exceeded its minimum.

FIG. 3 illustrates an operating curve 16 for a centrifugal pump 11 in which both the state of entry E and state of exit A of the fluid lie in the permitted range. The fluid, upon entry into the pump 11, has a state in which the real gas factor z has already exceeded its minimum. In the pump, the pressure p and temperatures T of the fluid change. The fluid enters the pump at a pressure of 95 bar and leaves the pump at a pressure of 300 bar. The inlet temperature of the fluid amounts to about 35° C. The outlet temperature of the fluid amounts to 70° C. According to the invention, the state of entry of the fluid was set by machines 1, 6 and/or appliances 3, 8 such that the fluid in the centrifugal pump 11 assume only states in which the real gas factor z of the fluid has already reached or exceeded its minimum. The operating curve 16 lies completely in the permitted range. In a similar way to FIG. 2, here too, the surge limit is illustrated as a bold unbroken boundary curve 17.

Figure 4A:
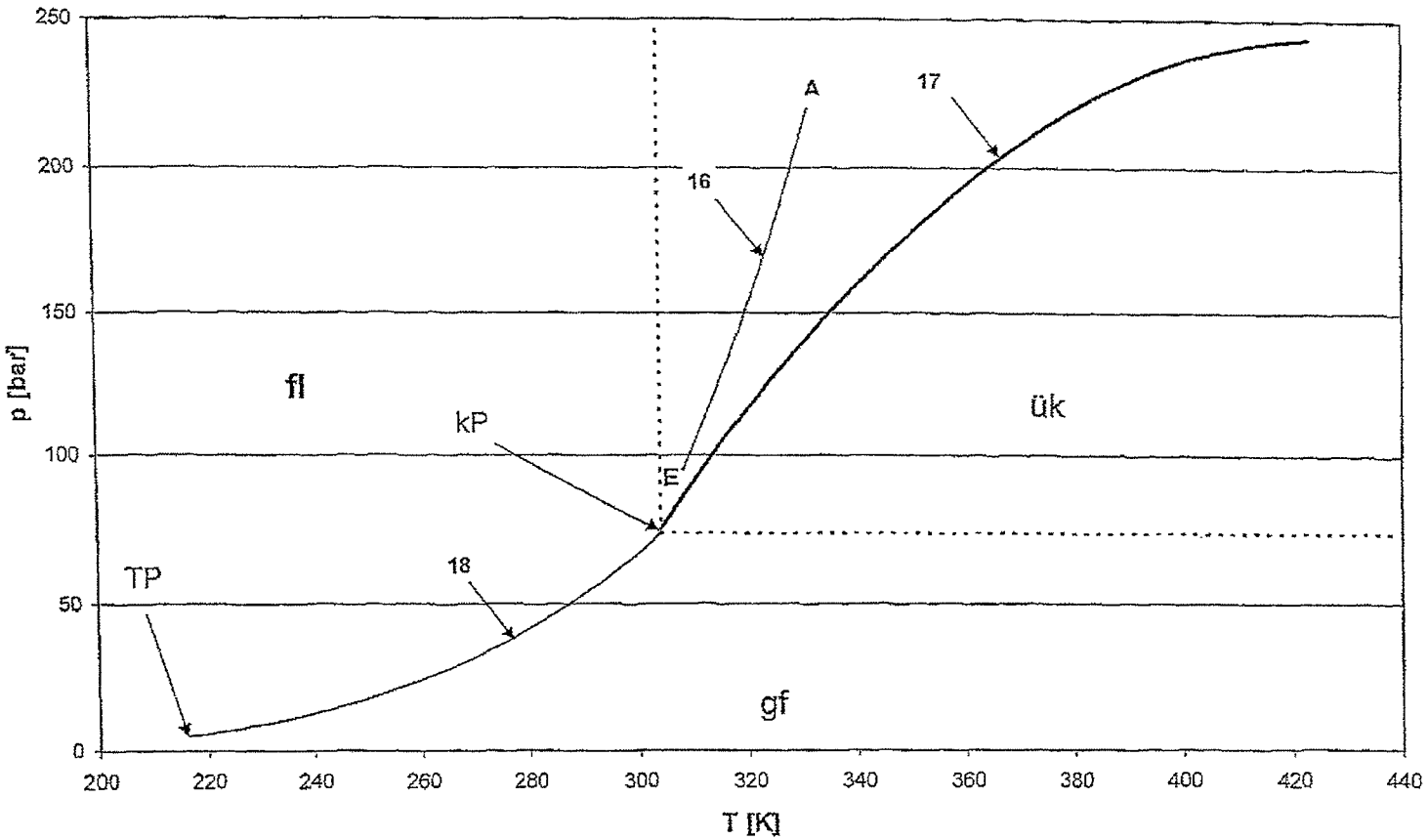
FIG. 4*a* shows the phase graph of carbon dioxide, the boundary line according to the invention for operating centrifugal pumps in the supercritical range being depicted, and the operating curve of the centrifugal pump running completely in the permitted range.
Figure 4B:
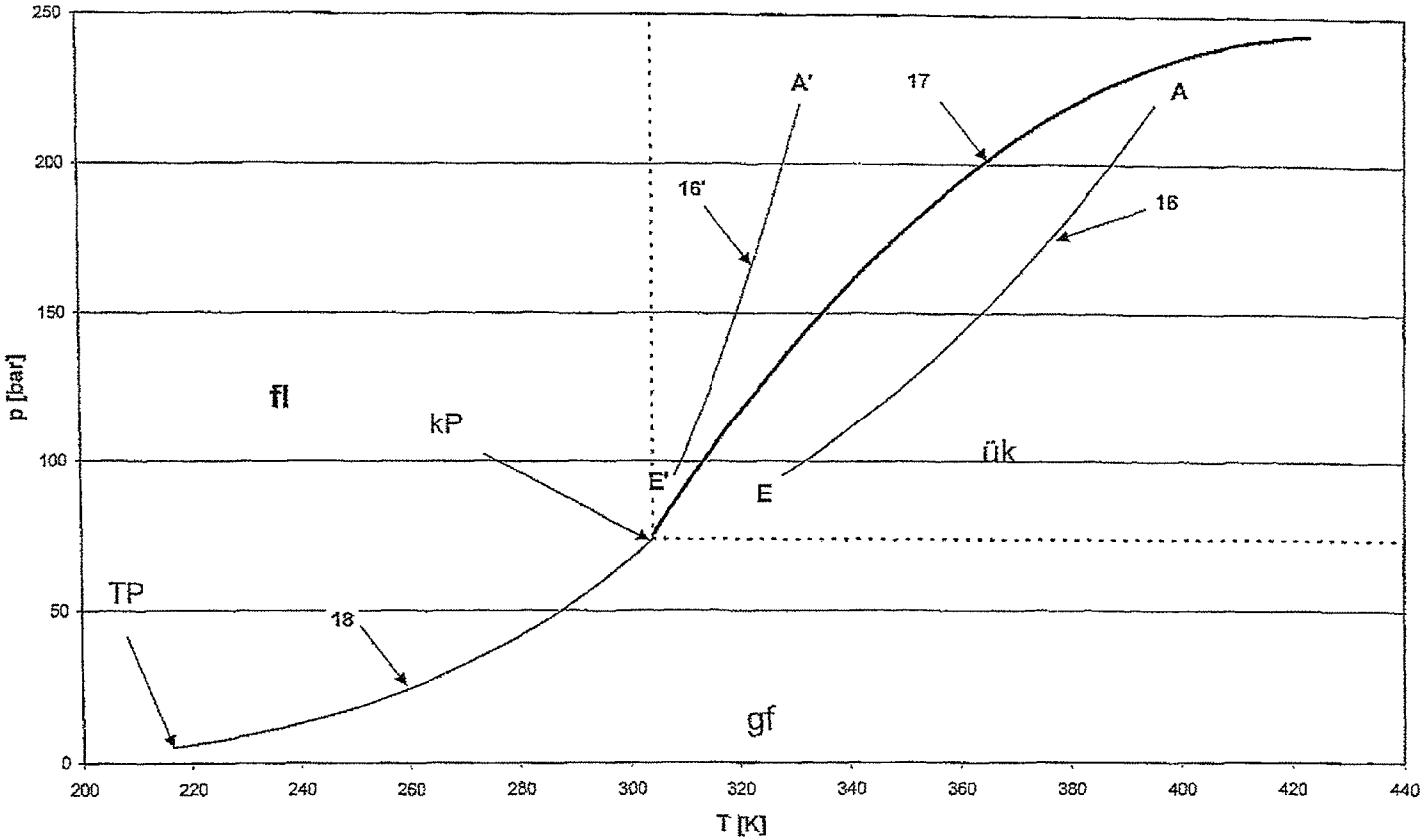
FIG. 4*b* shows the phase graph of carbon dioxide, the boundary line according to the invention for operating centrifugal pumps in the supercritical range being depicted, and the operating curve of the centrifugal pump first running completely in the prohibited range.
Figure 4C:
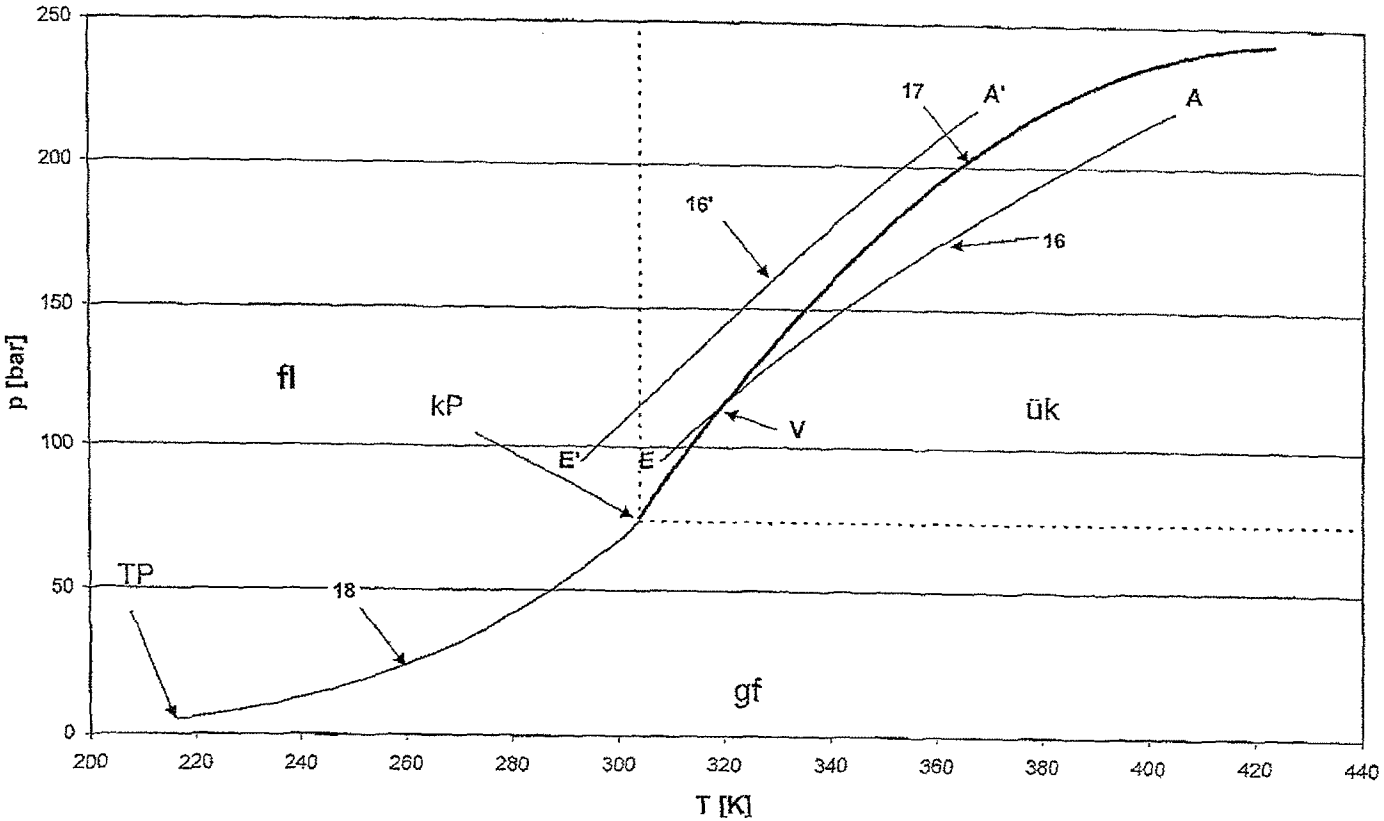
FIG. 4*c* shows the phase graph of carbon dioxide, the boundary line according to the invention for operating centrifugal pumps in the supercritical range being depicted, and the entry point lying in the permitted range, but the exit point first lying in the prohibited range.

FIGS. 4*a*, 4*b* and 4*c* show the phase graph of carbon dioxide which is also designated frequently as the state graph or p-T graph. As well as the customary states of aggregation, gaseous gf and liquid fl, the supercritical state ük is also depicted. It is clear from the graph that carbon dioxide cannot be liquid at a standard pressure of 1.013 bar, but only sublimation is observed at −78.5° C. Only at higher pressures can carbon dioxide be in the liquid state. For the conveyance of liquid carbon dioxide, the vapor pressure curve 18 constitutes a boundary line for the operating states which the fluid should assume in the centrifugal pump. The liquid carbon dioxide should not assume in the centrifugal pump any states in which the vapor pressure curve 18 is reached or exceeded, since otherwise cavitation occurs in the centrifugal pump. The vapor pressure curve 18 is delimited by the triple point TP and the critical point kP.

In the illustration in FIG. 4*a*, the state of entry E of the fluid to be conveyed is in the permitted range. Upon entry into the centrifugal pump 11, the fluid has a state in which the real gas factor z has already exceeded its minimum. Inside the centrifugal pump, the pressure and temperature of the fluid change. The fluid enters the pump at a pressure of 95 bar and leaves the pump at a pressure of 220 bar. The inlet temperature of the fluid amounts to 35° C. The outlet temperature of the fluid amounts to 59° C. According to the invention, the state of entry of the fluid was set by the machines 1, 6 and/or appliances 3, 8 such that the fluid in the centrifugal pump 11 assumes only states in which the real gas factor of the fluid has already reached or exceeded its minimum. The operating curve 16 lies completely in the permitted supercritical range allocated by the boundary curve 17. In this illustration of FIG. 4*a*, the permissible pump area is located on the left of the boundary curve 17.

In the example of the illustration in FIG. 4*b*, neither the state of entry E nor the state of exit A lie in the permitted range. The entire operating curve 16 lies on the right of the boundary curve 17 and therefore in the prohibited supercritical range, since the real gas factor z of the fluid to be conveyed has not yet reached its minimum. According to the invention, then, the state of entry of the fluid is varied by the machines 1, 6 and appliances 3, 8 such that the entire operating curve 16' lies in the permitted range, that is to say the fluid in the centrifugal pump 11 assumes only states in which the real gas factor of the fluid has already reached or exceeded its minimum. As a result, the entire operating curve 16 is displaced and then runs as a permissible operating curve 16' completely in the permitted range. The state of entry was varied by the machines 1, 6 and/or appliances 3, 8 such that the fluid enters the centrifugal pump 11 at a lower inlet temperature T. The entire operating curve is thereby displaced from 16 to 16', so that, according to the invention, the fluid in the centrifugal pump 11 then assumes only states in which the real gas factor z has already reached or exceeded its minimum. Alternatively to this, a higher inlet pressure p may also be set. All of the states lie in the permitted range after this variation of the state of entry.

In the illustration in FIG. 4*c*, although the state of entry E of the fluid lies in the permitted supercritical range, the state of exit A nevertheless lies in the prohibited range. In this case, upon entry into the pump, the fluid is first in a state in which the real gas factor z has already exceeded its minimum. The pressure and temperature of the fluid change inside the pump.

The fluid enters the pump at a pressure of 95 bar and leaves the pump at a pressure of 220 bar. The inlet temperature of the fluid amounts to 35° C. The outlet temperature of the fluid amounts to 130° C. From the point of intersection V of the operating curve 16 with the emboldened and unbroken boundary curve 17, the operating states of the fluid assume values at which the real gas factor of the fluid has not yet reached or exceeded its minimum. From this point of intersection at point V, the operating curve runs in the prohibited range. According to the invention, then, the state of entry of the fluid is varied by the machines 1, 6 and appliances 3, 8 such that the entire operating curve 16 lies in the permitted range, that is to say the fluid in the centrifugal pump assumes only states in which the real gas factor of the fluid has already reached over exceeded its minimum. The entry point E of the curve 16 is displaced further to the right, so that the fluid enters the centrifugal pump 11 at a lower inlet temperature at the entry point E'. As a result, the entire, here inadmissible operating curve 16 is displaced as a new and permissible operating curve 16' into the permitted supercritical range. Alternatively, a higher inlet pressure p may also be set. According to the invention, the fluid in the centrifugal pump then assumes only states in which the real gas factor has already reached or exceeded its minimum. All of the states lie in the permitted range after this variation of the state of entry.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A method for the conveyance of a fluid with a centrifugal pump, wherein machines and/or appliances which influence the pressure and/or temperature of the fluid are arranged upstream of the centrifugal pump, and the state of the fluid upon entry into the centrifugal pump is set by the machines and/or appliances such that the fluid in the centrifugal pump assumes only states in which the real gas factor of the fluid has already reached or exceeded the minimum value thereof.

2. The method as claimed in claim 1, wherein the fluid is in a supercritical state upon entry into the centrifugal pump and/or in the centrifugal pump.

3. The method as claimed in claim 1, wherein, in the event of an increase in pressure in the centrifugal pump, the real gas factor of the fluid remains the same or increases.

4. The method as claimed in claim 1, wherein the inlet temperature and/or the inlet pressure of the fluid is measured and transmitted to a control or regulating unit.

5. The method as claimed in claim 4, wherein the control or regulating unit transmits signals to the machines and/or appliances for regulating the state in which the fluid enters the centrifugal pump.

6. The method as claimed in claim 4, wherein the control or regulating unit triggers an alarm when the real gas factor of the fluid upon entry into the centrifugal pump is less than the minimum value thereof.

7. The method as claimed in claim 4, wherein the control or regulating unit switches the method into a safety mode when the real gas factor of the fluid upon entry into the centrifugal pump is less than the minimum value thereof.

8. The method as claimed in claim 1, wherein the state in which the fluid enters the centrifugal pump is set by a machine constructed as a compressor and/or by an appliance constructed as a heat exchanger.

9. The method as claimed in claim 8, wherein the fluid to be conveyed passes through at least one compression stage and/or at least one cooling stage.

10. A method for the sequestration of carbon dioxide, in which carbon dioxide is brought to a pressure and/or temperature suitable for an intended storage location and is conveyed into the storage location, wherein a centrifugal pump pumps the carbon dioxide into the storage location;

at least one machine and/or appliance which influences the pressure and/or temperature of the carbon dioxide is arranged upstream of the centrifugal pump; and the state in which the fluid enters the centrifugal pump is set by the at least one machine and/or appliance such that the fluid in the centrifugal pump assumes only states in which the real gas factor of the fluid has already reached or exceeded its minimum value.

11. The method as claimed in claim 10, wherein the fluid is in a supercritical state upon entry into the centrifugal pump and/or in the centrifugal pump.

12. The method as claimed in claim 10, wherein, in the event of an increase in pressure in the centrifugal pump, the real gas factor of the fluid in the pump remains the same or increases.

13. The method as claimed in claim 10, wherein the inlet temperature and/or the inlet pressure of the fluid is measured and transmitted to a control or regulating unit.

14. The method as claimed in claim 13, wherein the control or regulating unit transmits a signal to the at least one machine and/or appliance for regulating the state in which the fluid enters the centrifugal pump.

15. The method as claimed in claim 13, wherein the control or regulating unit triggers an alarm when the real gas factor of the fluid upon entry into the centrifugal pump is less than the minimum value thereof.

16. The method as claimed in claim 13, wherein the control or regulating unit shuts down the plant when the real gas factor of the fluid upon entry into the centrifugal pump is less than the minimum value thereof.

17. The method as claimed in claim 10, wherein the state of entry of the fluid into the centrifugal pump is regulated by at least one machine constructed as a compressor and/or by at least one appliance constructed as a heat exchanger.

18. The method as claimed in claim 17, wherein the fluid to be conveyed passes through at least one compression stage and/or at least one cooling stage.

* * * * *